US010837679B2

(12) United States Patent
Davis, II et al.

(10) Patent No.: US 10,837,679 B2
(45) Date of Patent: Nov. 17, 2020

(54) METHOD AND APPARATUS FOR PART-LOAD OPTIMIZED REFRIGERATION SYSTEM WITH INTEGRATED INTERTWINED ROW SPLIT CONDENSER COIL

(71) Applicant: Lennox Industries Inc., Richardson, TX (US)

(72) Inventors: Walter Davis, II, Dallas, TX (US); Colin Clara, Frisco, TX (US); Eric Perez, Hickory Creek, TX (US); Eric Chanthalangsy, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 16/553,242

(22) Filed: Aug. 28, 2019

(65) Prior Publication Data

US 2019/0383523 A1 Dec. 19, 2019

Related U.S. Application Data

(62) Division of application No. 15/479,576, filed on Apr. 5, 2017, now Pat. No. 10,415,856.

(51) Int. Cl.
*F25B 5/02* (2006.01)
*F25B 1/00* (2006.01)
(Continued)

(52) U.S. Cl.
CPC ..... *F25B 5/02* (2013.01); *F25B 1/00* (2013.01); *F25B 39/00* (2013.01); *F25B 41/04* (2013.01); *F25B 49/02* (2013.01); *F28D 1/0477* (2013.01); *F25B 39/028* (2013.01); *F25B 2400/061* (2013.01); *F25B 2500/18* (2013.01); *F25B 2600/2511* (2013.01); *F28D 1/0452* (2013.01); *F28D 2021/007* (2013.01)

(58) Field of Classification Search
CPC .. F25B 5/02; F25B 49/02; F25B 39/00; F25B 2500/18; F25B 2400/061; F25B 39/028; F28D 2021/007
See application file for complete search history.

(56) References Cited

U.S. PATENT DOCUMENTS 2,881,600 A * 4/1959 Elfving ..... B61D 27/0081 62/239
3,142,970 A * 8/1964 Hale ..... F25B 47/025 62/324.1

(Continued)

FOREIGN PATENT DOCUMENTS

FR 2758615 A1 7/1998
JP H0914698 A 1/1997
WO WO-2016/173790 A1 11/2016

*Primary Examiner* — Kun Kai Ma
(74) *Attorney, Agent, or Firm* — Shackelford, Bowen, McKinley & Norton, LLP

(57) ABSTRACT

A condenser system that includes a first compressor and a second compressor. An upper coil and a de-superheater coil are fluidly coupled to the first compressor. The upper coil, the de-superheater coil, and the first compressor define a first compressor circuit. A lower coil is fluidly coupled to the second compressor. The lower coil and the second compressor define a second compressor circuit. The upper coil and the de-superheater coil together utilize an entire heat-transfer surface area.

18 Claims, 8 Drawing Sheets

(51) Int. Cl.

| | |
|---|---|
| ***F28D 1/047*** | (2006.01) |
| ***F25B 39/00*** | (2006.01) |
| ***F25B 41/04*** | (2006.01) |
| ***F25B 49/02*** | (2006.01) |
| ***F28D 1/04*** | (2006.01) |
| ***F28D 21/00*** | (2006.01) |
| ***F25B 39/02*** | (2006.01) |

(56) References Cited

U.S. PATENT DOCUMENTS

| | | | | |
|---|---|---|---|---|
| 3,866,439 | A * | 2/1975 | Bussjager | F25B 39/02 62/504 |
| 4,105,064 | A | 8/1978 | Del Toro et al. | |
| 4,259,847 | A | 4/1981 | Pearse, Jr. | |
| 4,332,137 | A | 6/1982 | Hayes, Jr. | |
| 5,205,130 | A | 4/1993 | Pannell | |
| 5,307,645 | A | 5/1994 | Pannell | |
| 5,875,637 | A | 3/1999 | Paetow | |
| 6,658,867 | B1 | 12/2003 | Taras et al. | |
| 6,705,093 | B1 * | 3/2004 | Taras | F24F 3/153 62/238.6 |
| 6,978,630 | B2 | 12/2005 | Wensink et al. | |
| 9,980,413 | B2 | 5/2018 | Judge et al. | |
| 2001/0027660 | A1 | 10/2001 | Moffa | |
| 2002/0092318 | A1 | 7/2002 | Tipton et al. | |
| 2004/0089002 | A1 | 5/2004 | Rayburn | |
| 2004/0089015 | A1 | 5/2004 | Knight et al. | |
| 2005/0022541 | A1 | 2/2005 | Rayburn et al. | |
| 2006/0201188 | A1 | 9/2006 | Kopko | |
| 2010/0064722 | A1 * | 3/2010 | Taras | F25B 49/02 62/498 |
| 2010/0242508 | A1 * | 9/2010 | Lifson | F25B 41/062 62/115 |
| 2011/0192188 | A1 | 8/2011 | Nickey et al. | |
| 2013/0227985 | A1 * | 9/2013 | Komano | F25B 1/00 62/404 |
| 2015/0345848 | A1 | 12/2015 | Him et al. | |
| 2018/0164010 | A1 | 6/2018 | Mackey et al. | |
| 2020/0096236 | A1 * | 3/2020 | Rajan | F25B 41/04 |

* cited by examiner

METHOD AND APPARATUS FOR PART-LOAD OPTIMIZED REFRIGERATION SYSTEM WITH INTEGRATED INTERTWINED ROW SPLIT CONDENSER COIL

CROSS-REFERENCE TO RELATED APPLICATION

This application is a divisional of U.S. patent application Ser. No. 15/479,576, filed on Apr. 5, 2017. U.S. patent application Ser. No. 15/479,576 is incorporated herein by reference.

TECHNICAL FIELD

This application relates to optimization of a heating ventilation and air conditioning (HVAC) system and more particularly, but not by way of limitation, to optimization of an HVAC system during part-load operation utilizing a de-superheated condenser circuit, unequal compressor sizes, and an unequal face split evaporator coil.

BACKGROUND

Several industry standards and federal regulations specify minimum acceptable efficiency of heating, ventilation, and air conditioning (HVAC) systems. Traditionally. HVAC system efficiency has been measured at full-load operating conditions. Efficiency at full-load operating conditions could be improved by adjusting the size of the condenser coils or the size of the compressor. Under current guidelines, however, more emphasis is placed on operating efficiency at part-load operating conditions. Thus, it becomes a challenge to increase efficient performance in an HVAC system that is already at maximum capacity. One approach is to utilize variable air volume designs in order to reduce air volume and power consumption during part-load operating conditions. However, it has been found to be cost prohibitive to retro-fit existing HVAC systems for variable air volume operation.

SUMMARY

This application relates to optimization of a heating ventilation and air conditioning (HVAC) system and more particularly, but not by way of limitation, to optimization of an HVAC system during part-load operation utilizing a de-superheated condenser circuit, unequal compressor sizes, and an unequal face split evaporator coil. In one aspect, the present invention relates to a condenser system. The condenser system includes a first compressor and a second compressor. An upper coil and a de-superheater coil are fluidly coupled to the first compressor. The upper coil, the de-superheater coil, and the first compressor define a first compressor circuit. A lower coil is fluidly coupled to the second compressor. The lower coil and the second compressor define a second compressor circuit. The upper coil and the de-superheater coil together utilize an entire heat-transfer surface area.

In another aspect, the present invention relates to an evaporator system. The evaporator system includes a high-capacity evaporator coil fluidly coupled to a high-capacity refrigerant line. A low-capacity evaporator coil is fluidly coupled to a low-capacity refrigerant line. A solenoid valve is fluidly coupling the high-capacity refrigerant line to the low-capacity refrigerant line. The solenoid valve is closed responsive to a reduced mass flow rate of refrigerant. The solenoid valve, when closed, restricts flow of refrigerant to the high-capacity evaporator coil.

In another aspect, the present invention relates to a method of improving HVAC efficiency. The method includes arranging an upper coil above a lower coil. A de-superheater coil is arranged downstream of the lower coil. The upper coil and the de-superheater are fluidly coupled coil to a first compressor thereby defining a first compressor circuit. The lower coil is fluidly coupled to a second compressor thereby defining a second compressor circuit.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
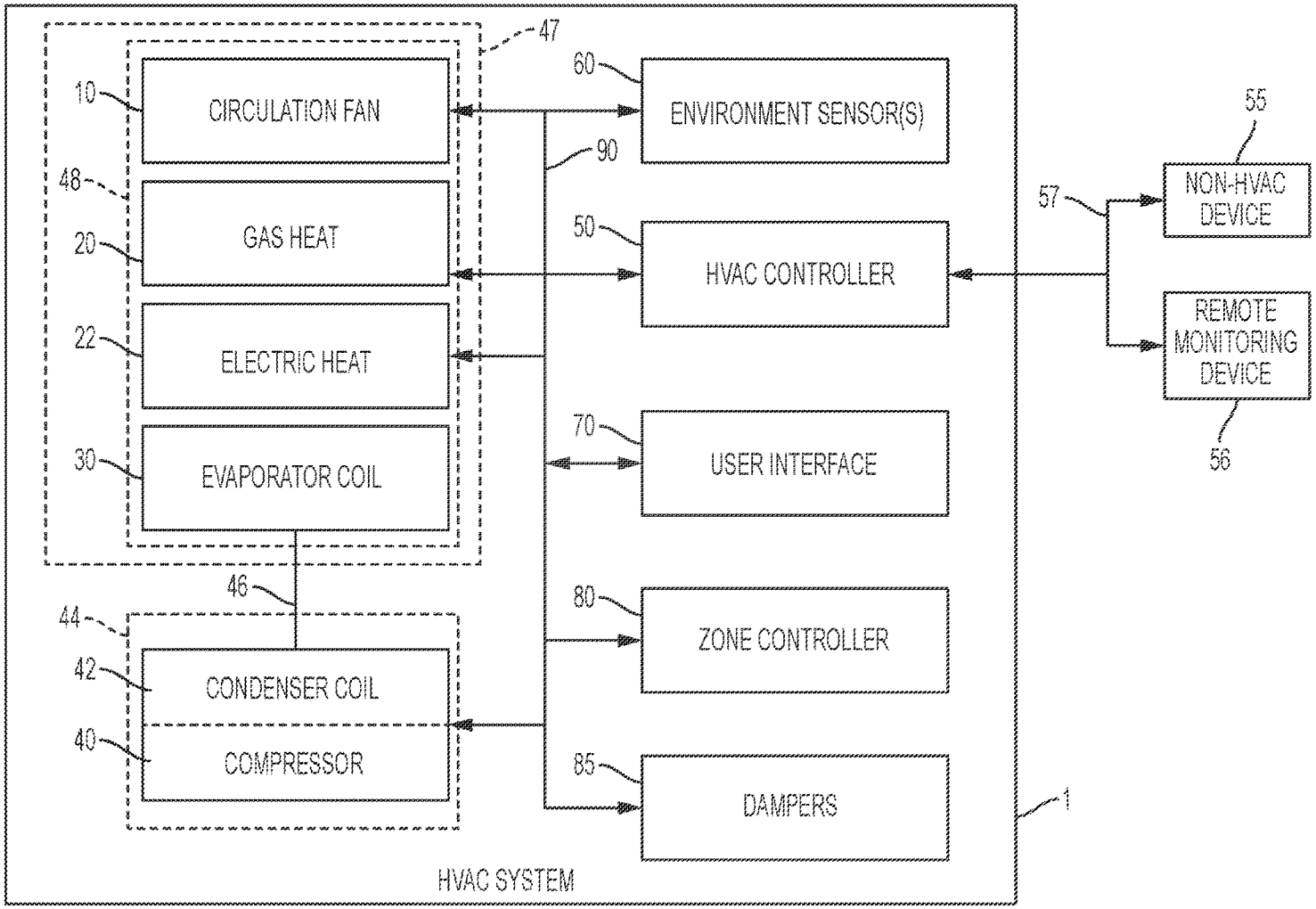
FIG. 1 is a block diagram of an HVAC system.

FIG. 1 illustrates an HVAC system 1. In a typical embodiment, the HVAC system 1 is a networked HVAC system that is configured to condition air via, for example, heating, cooling, humidifying, or dehumidifying air. The HVAC system 1 can be a residential system or a commercial system such as, for example, a roof top system. For exemplary illustration, the HVAC system 1 as illustrated in FIG. 1 includes various components; however, in other embodiments, the HVAC system 1 may include additional components that are not illustrated but typically included within HVAC systems.

The HVAC system 1 includes a circulation fan 10, a gas heat 20, electric heat 22 typically associated with the circulation fan 10, and a refrigerant evaporator coil 30, also typically associated with the circulation fan 10. In various embodiments, the circulation fan 10 may be a single-speed circulation fan or a variable-speed circulation fan. The circulation fan 10, the gas heat 20, the electric heat 22, and the refrigerant evaporator coil 30 are collectively referred to as an "indoor unit" 48. In a typical embodiment, the indoor unit 48 is located within, or in close proximity to, an enclosed space 47. The HVAC system 1 also includes a compressor 40 and an associated condenser coil 42, which are typically referred to as an "outdoor unit" 44. In various embodiments, the outdoor unit 44 is, for example, a rooftop unit or a ground-level unit. The compressor 40 and the associated condenser coil 42 are connected to an associated evaporator coil 30 by a refrigerant line 46. In a typical embodiment, the compressor 40 is, for example, a single-stage compressor, a multi-stage compressor, a single-speed compressor, or a variable-speed compressor. Also, as will be discussed in more detail below, in various embodiments, the compressor 40 may be a compressor system including at least two compressors of the same or different capacities. In some embodiments, the circulation fan 10, sometimes referred to as a blower, is configured to operate at different capacities (i.e., variable motor speeds) to circulate air through the HVAC system 1, whereby the circulated air is conditioned and supplied to the enclosed space 47.

Still referring to FIG. 1, the HVAC system 1 includes an HVAC controller 50 that is configured to control operation of the various components of the HVAC system 1 such as, for example, the circulation fan 10, the gas heat 20, the electric heat 22, and the compressor 40. In some embodiments, the HVAC system 1 can be a zoned system. In such embodiments, the HVAC system 1 includes a zone controller 80, dampers 85, and a plurality of environment sensors 60. In a typical embodiment, the HVAC controller 50 cooperates with the zone controller 80 and the dampers 85 to regulate the environment of the enclosed space 47.

The HVAC controller 50 may be an integrated controller or a distributed controller that directs operation of the HVAC system 1. In a typical embodiment, the HVAC controller 50 includes an interface to receive, for example, thermostat calls, temperature setpoints, blower control signals, environmental conditions, and operating mode status for various zones of the HVAC system 1. In a typical embodiment, the HVAC controller 50 also includes a processor and a memory to direct operation of the HVAC system 1 including, for example, a speed of the circulation fan 10.

Still referring to FIG. 1, in some embodiments, the plurality of environment sensors 60 is associated with the HVAC controller 50 and also optionally associated with a user interface 70. In some embodiments, the user interface 70 provides additional functions such as, for example, operational, diagnostic, status message display, and a visual interface that allows at least one of an installer, a user, a support entity, and a service provider to perform actions with respect to the HVAC system 1. In some embodiments, the user interface 70 is, for example, a thermostat of the HVAC system 1. In other embodiments, the user interface 70 is associated with at least one sensor of the plurality of environment sensors 60 to determine the environmental condition information and communicate that information to the user. The user interface 70 may also include a display, buttons, a microphone, a speaker, or other components to communicate with the user. Additionally, the user interface 70 may include a processor and memory that is configured to receive user-determined parameters, and calculate operational parameters of the HVAC system 1 as disclosed herein.

In a typical embodiment, the HVAC system 1 is configured to communicate with a plurality of devices such as, for example, a monitoring device 56, a communication device 55, and the like. In a typical embodiment, the monitoring device 56 is not part of the HVAC system. For example, the monitoring device 56 is a server or computer of a third party such as, for example, a manufacturer, a support entity, a service provider, and the like. In other embodiments, the monitoring device 56 is located at an office of, for example, the manufacturer, the support entity, the service provider, and the like.

In a typical embodiment, the communication device 55 is a non-HVAC device having a primary function that is not associated with HVAC systems. For example, non-HVAC devices include mobile-computing devices that are configured to interact with the HVAC system 1 to monitor and modify at least some of the operating parameters of the HVAC system 1. Mobile computing devices may be, for example, a personal computer (e.g., desktop or laptop), a tablet computer, a mobile device (e.g., smart phone), and the like. In a typical embodiment, the communication device 55 includes at least one processor, memory and a user interface, such as a display. One skilled in the art will also understand that the communication device 55 disclosed herein includes other components that are typically included in such devices including, for example, a power supply, a communications interface, and the like.

The zone controller 80 is configured to manage movement of conditioned air to designated zones of the enclosed space 47. Each of the designated zones include at least one conditioning or demand unit such as, for example, the gas heat 20 and at least one user interface 70 such as, for example, the thermostat. The zone-controlled HVAC system 1 allows the user to independently control the temperature in the designated zones. In a typical embodiment, the zone controller 80 operates electronic dampers 85 to control air flow to the zones of the enclosed space 47.

In some embodiments, a data bus 90, which in the illustrated embodiment is a serial bus, couples various components of the HVAC system 1 together such that data is communicated therebetween. In a typical embodiment, the data bus 90 may include, for example, any combination of hardware, software embedded in a computer readable medium, or encoded logic incorporated in hardware or otherwise stored (e.g., firmware) to couple components of the HVAC system 1 to each other. As an example and not by way of limitation, the data bus 90 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 90 may include any number, type, or configuration of data buses 90, where appropriate. In particular embodiments, one or more data buses 90 (which may each include an address bus and a data bus) may couple the HVAC controller 50 to other components of the HVAC system 1. In other embodiments, connections between various components of the HVAC system 1 are wired. For example, conventional cable and contacts may be used to couple the HVAC controller 50 to the various components. In some embodiments, a wireless connection is employed to provide at least some of the connections between components of the HVAC system such as, for example, a connection between the HVAC controller 50 and the circulation fan 10 or the plurality of environment sensors 60.

Figure 2:
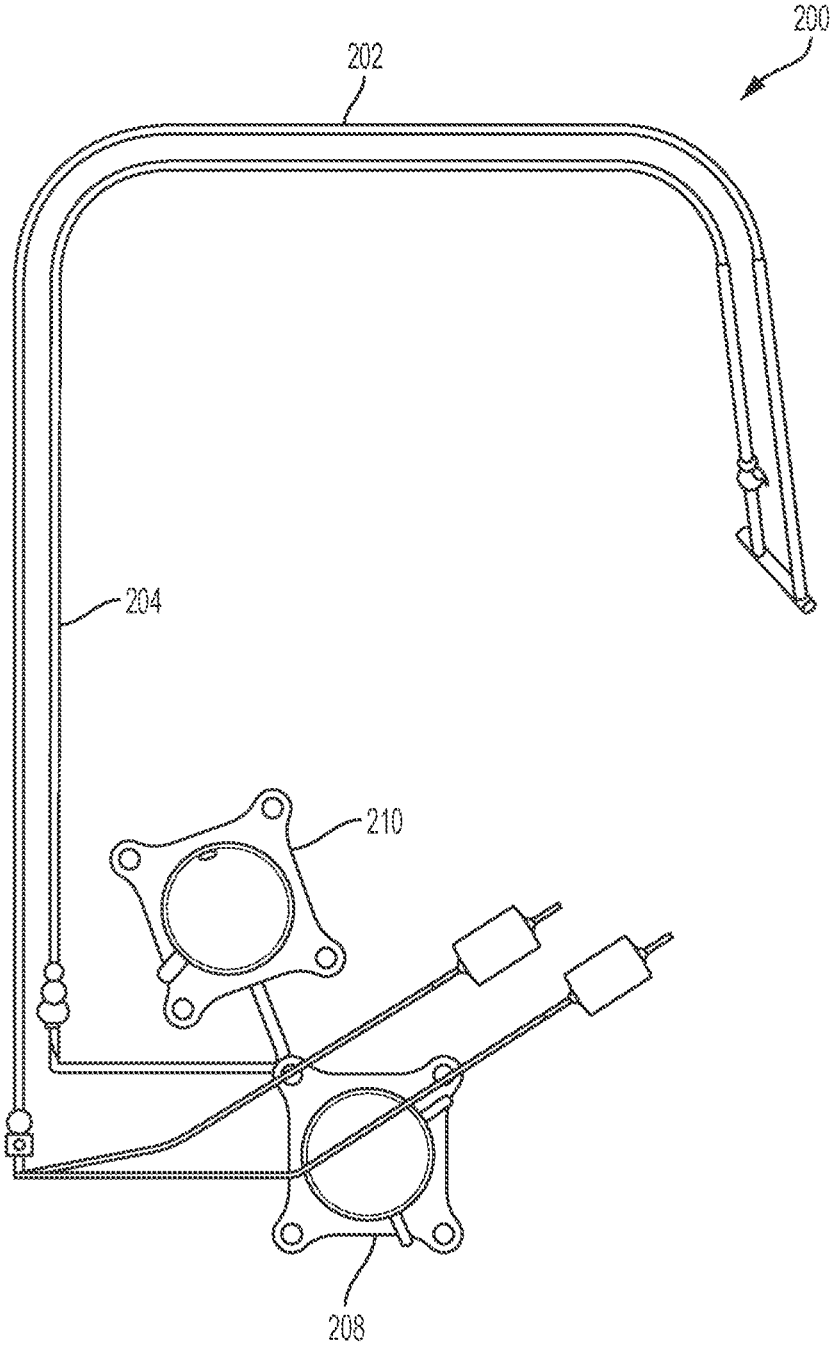
FIG. 2 is a top view of an exemplary condenser system.
Figure 3:
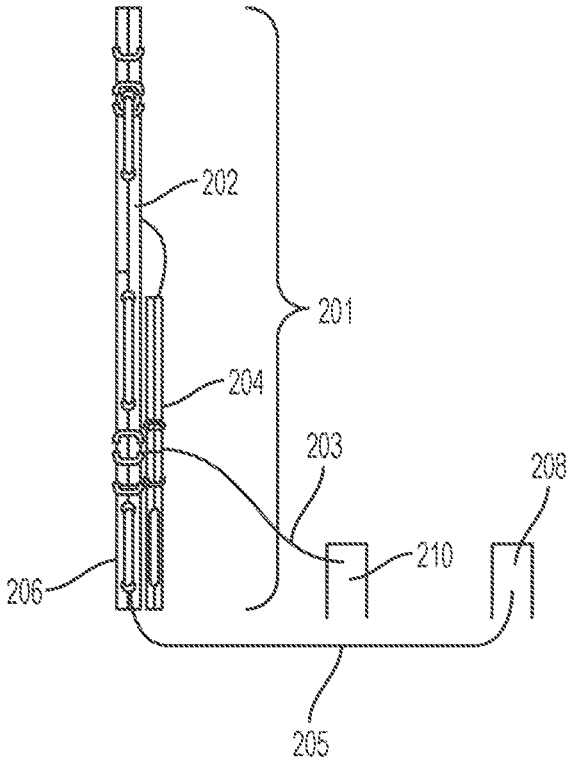
FIG. 3 is a side view of an exemplary condenser system.

FIGS. 2-3 are top and side views of an exemplary condenser system 200, respectively. Referring to FIGS. 2-3 collectively, the condenser system 200 includes an upper coil 202, a lower coil 206, and a de-superheater coil 204. The upper coil 202 is arranged above the lower coil 206. The de-superheater coil 204 is positioned inwardly, that is downstream, of the lower coil 206. The upper coil 202 and the lower coil 206 together occupy an entire heat-transfer surface area 201 of the condenser system 200. The condenser system 200 further includes a first compressor 210 and a second compressor 208. The first compressor 210 is fluidly coupled to the upper coil 202 and the de-superheater coil 204 to form a first compressor circuit 203. The second compressor 208 is fluidly coupled to the lower coil 206 to form a second compressor circuit 205. In a typical embodiment, the de-superheater coil 204 increases a heat-rejection capacity of the condenser system 200.

Still referring to FIGS. 2-3, in a typical embodiment, the first compressor 210 is of a larger capacity than the second compressor 208. For example, the first compressor 210 may have a 7.5 Ton capacity and the second compressor 208 may have a 5 Ton capacity. Compressor capacity relates to refrigerant flow rate and, thus, to the heat-rejection rate of the first compressor 210 and the second compressor 208. The increased relative size of the first compressor 210 allows the condenser system 200 to take advantage of high blower speed at low stage thereby allowing for an increased heat-removal capability of the first compressor circuit 203. In some embodiments, the first compressor 210 may be operated independently of the second compressor 208. Thus, the first compressor circuit 203 and the second compressor circuit 205 may be selectively activated and deactivated so as to adjust the capacity of the condenser system 200 during part-load operation.

Figure 4B:
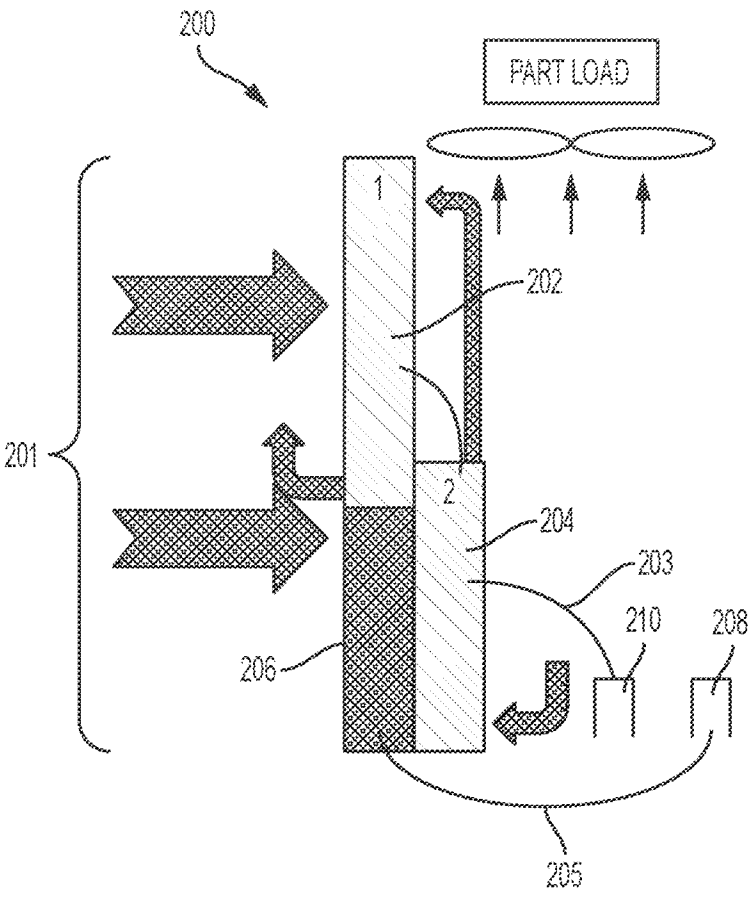
FIGS. 4A-4B are schematic side views of an exemplary condenser system during full-load operation and part-load operation, respectively.
Figure 4A:
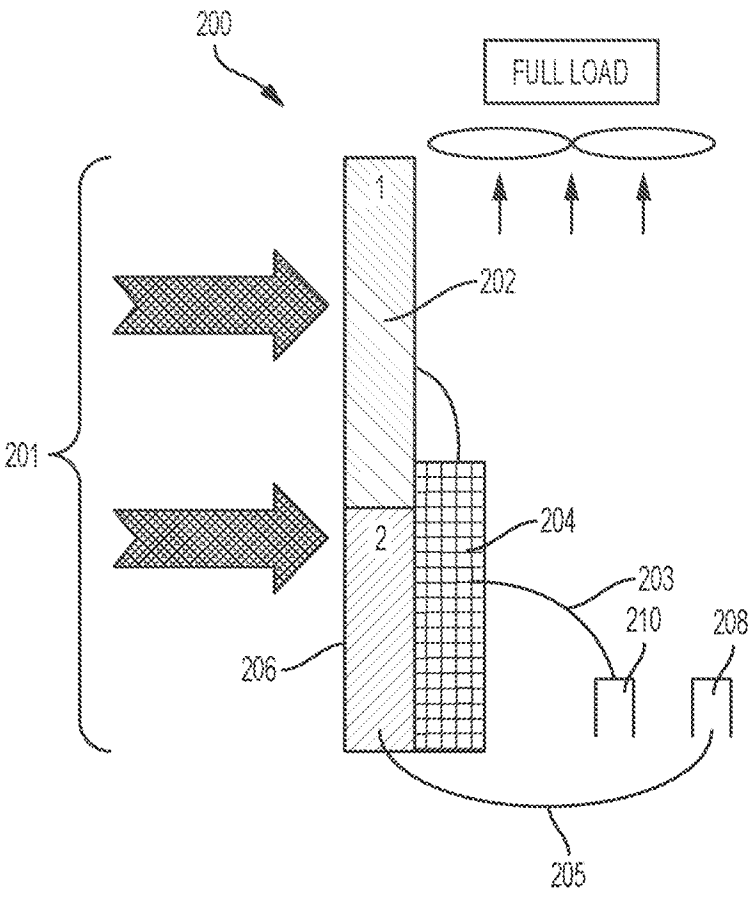

FIG. 4A is a schematic side view of the exemplary condenser system 200 during full-load operation. For purposes of discussion, FIG. 4A will be described herein relative to FIGS. 2-3. During full-load operation, the first compressor 210 and the second compressor 208 are operational and drive the first compressor circuit 203 and the second compressor circuit 205, respectively. In this situation, the upper coil 202 and the lower coil 206 are operational together with the de-superheater coil 204. In this manner, an entire heat-transfer surface area 201 is utilized for heat transfer by the upper coil 202 and the lower coil 206 together with the de-superheater coil 204. Thus, the combined effect of the upper coil 202, the lower coil 206, and the de-superheater coil 204 increases the heat-rejection capacity of the condenser system 200; however, the de-superheater coil 204 does not impact the ambient temperature of the lower coil 206.

FIG. 4B is a schematic side view of the condenser system 200 during partial-load operation. For purposes of discussion, FIG. 4B will be described herein relative to FIGS. 2-3. During partial-load operation, the second compressor 208 is deactivated. Deactivation of the second compressor 208 deactivates the second compressor circuit 205 and the lower coil 206. The upper coil 202 remains active together with the de-superheater coil 204. In this manner, the entire heat-transfer surface area 201 is utilized by the upper coil 202 and the de-superheater coil 304. Thus, efficiency of the condenser system 200 is not adversely impacted during partial load operation.

Figure 5B:
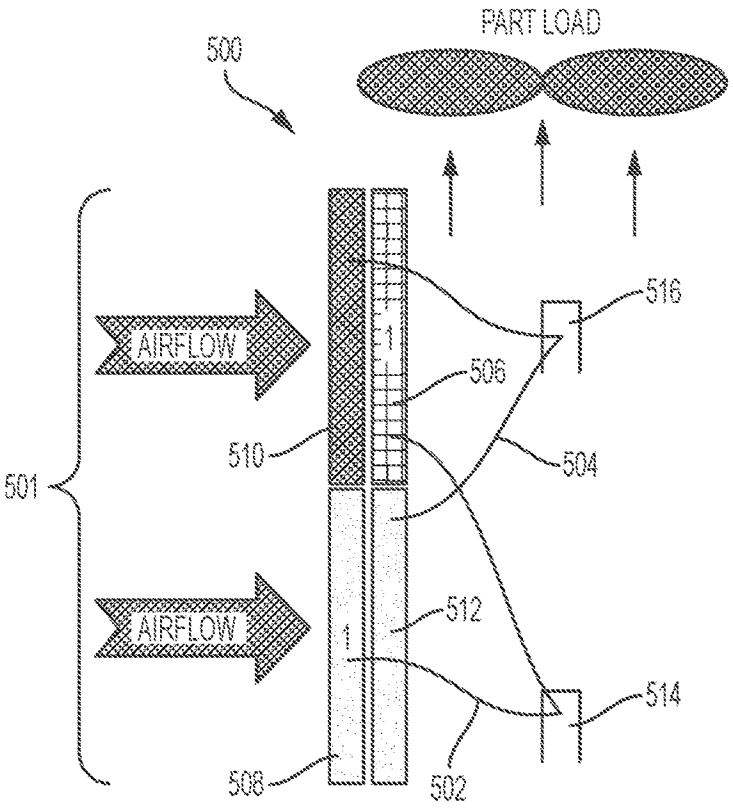
FIG. 5B is a schematic side view of an exemplary intertwined condenser system during part-load operation.
Figure 5A:
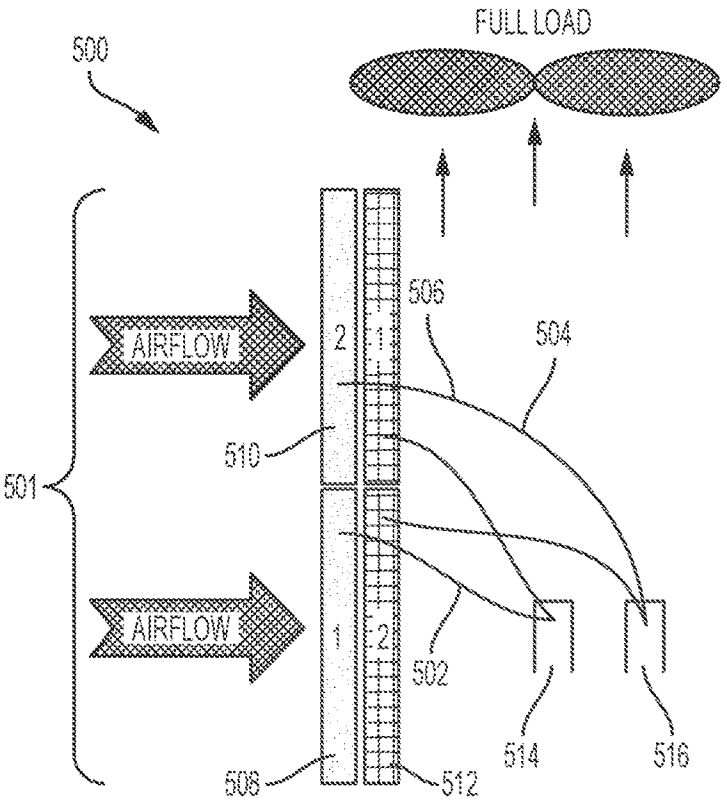
FIG. 5A is a schematic side view of an exemplary intertwined condenser system during full-load operation.

FIG. 5A is a schematic side view of an exemplary intertwined condenser system 500 during full-load operation. The intertwined condenser system 500 includes a first compressor circuit 502 and a second compressor circuit 504. The first compressor circuit 502 includes a first upper coil 506 arranged above a first lower coil 508. The first upper coil 506 and the first lower coil 508 are fluidly coupled to a first compressor 514 to form the first compressor circuit 502. The second compressor circuit 504 includes a second upper coil 510 arranged above a second lower coil 512. The second upper coil 510 and the second lower coil 512 are fluidly coupled to a second compressor 516 to form the second compressor circuit 504. The first upper coil 506 is positioned inwardly, that is downstream, of the second upper coil 510. The second lower coil 512 is positioned inwardly, that is downstream, of the first lower coil 508. During full-load operation, the first compressor circuit 502 and the second compressor circuit 504 are operational. Thus, the intertwined condenser system 500 utilizes the combined effect of the first upper coil 506, the second upper coil 510, the first lower coil 508, and the second lower coil 512. In this manner, the first compressor circuit 502 and the second compressor circuit 504 utilize an entire heat-transfer surface area 501.

FIG. 5B is a schematic side view of the exemplary intertwined condenser system 500 during part-load operation. During part-load operation, the second compressor circuit 504 is deactivated thereby deactivating the second upper coil 510 and the second lower coil 512. The first compressor circuit 502 remains active. Thus, the first upper coil 506 and the first lower coil 508 remain active. The first upper coil 506 and the first lower coil 508 utilize the entire heat-transfer surface area 501. Thus, efficiency of the intertwined condenser system 500 is not adversely impacted during partial load operation.

Figure 6:
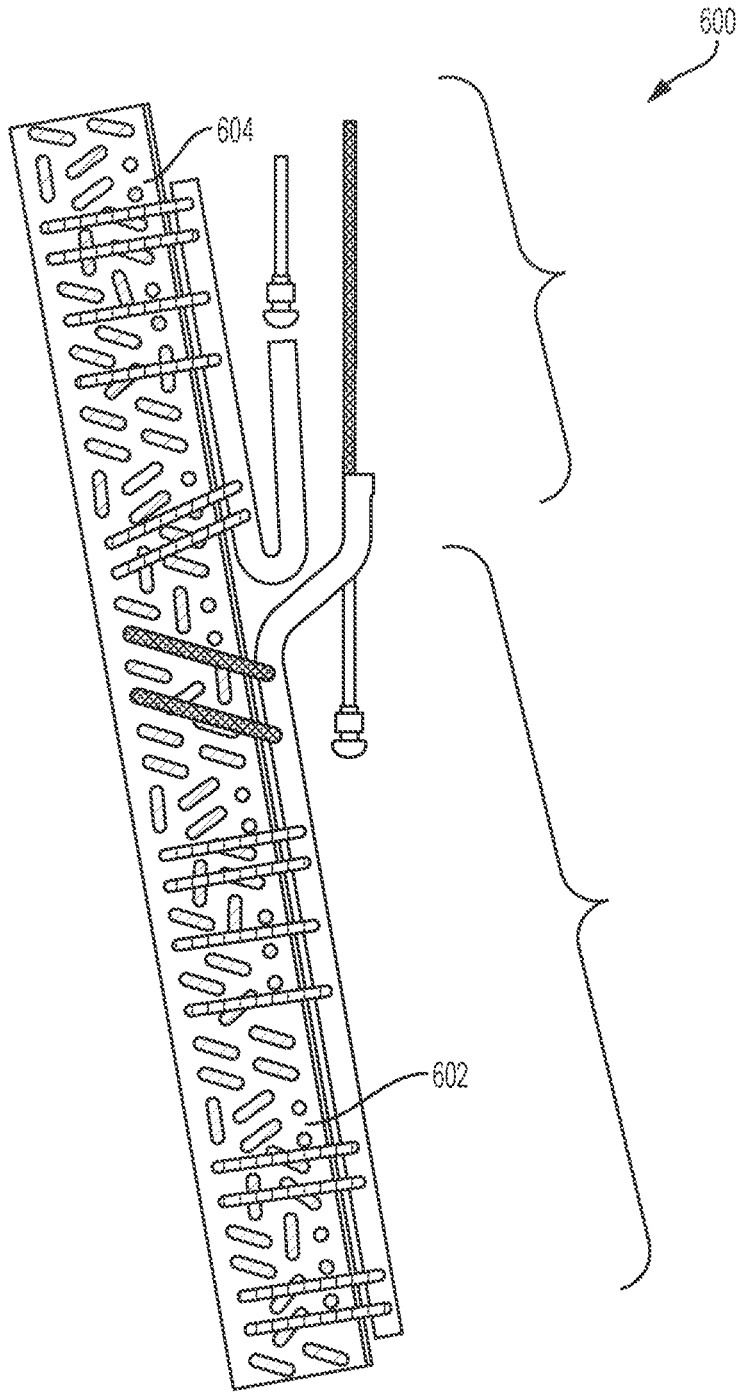
FIG. 6 is a side view of an exemplary evaporator system illustrating unequal face split.

FIG. 6 is a side view of an exemplary evaporator system 600. For purposes of discussion. FIG. 6 will be described herein relative to FIGS. 2-3. In a typical embodiment, the evaporator system 600 is used in conjunction with the condenser system 200; however, the evaporator system 600 may also be used in conjunction with the intertwined condenser system 500. For purposes of discussion, the evaporator system 600 will be described herein as being utilized with the condenser system 200. As illustrated in FIG. 6, the evaporator system 600 includes a first evaporator coil 602 and a second evaporator coil 604. The first evaporator coil 602 is associated with the first compressor circuit 203 and the second evaporator coil 604 is associated with the second compressor circuit 205. In a typical embodiment, the first evaporator coil 602 occupies a larger area than the second evaporator coil 604. In a typical embodiment, the first evaporator coil 602 and the second evaporator coil 604 are formed utilizing an increased fin density thereby increasing the heat rejection rate of the refrigerant through the evaporator system 600. Currently, typical evaporator coils utilize approximately 14 fins per inch ("FPI"). In a typical embodiment, the first evaporator coil 602 and the second evaporator coil 604 are constructed with approximately 17 FPI. The increased fin density allows the evaporator system 600 to accommodate the increased heat-rejection capacity of, for example, the condenser system 200 discussed above with respect to FIGS. 2-3.

Figure 7:
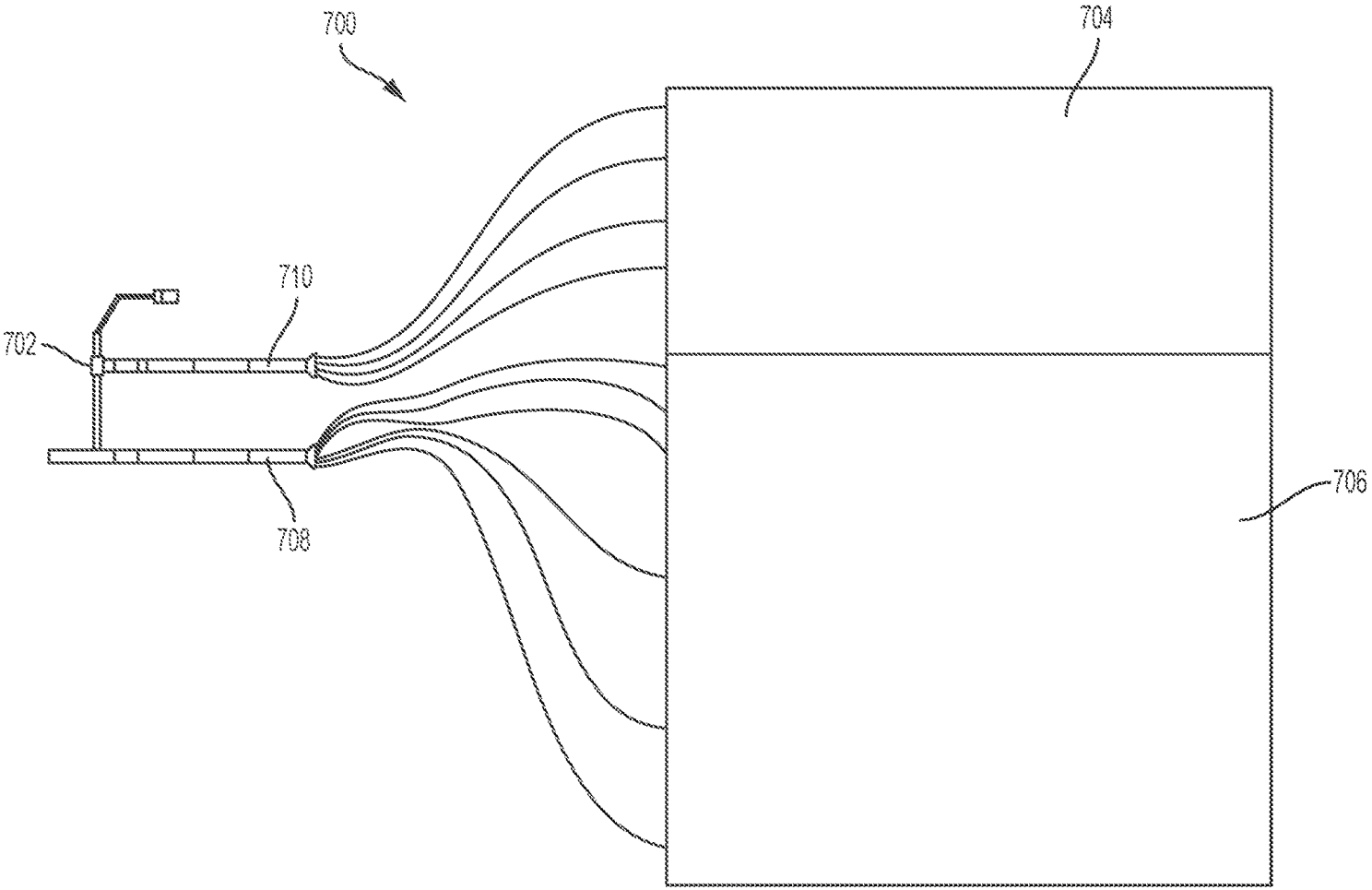
FIG. 7 is a schematic side view of an exemplary evaporator system including an electronic solenoid valve illustrating an exemplary process for improving HVAC comfort.

FIG. 7 is a schematic side view of an exemplary evaporator system 700 including an electronic solenoid valve 702. The evaporator system 700 includes a high-capacity coil 704 and a low-capacity coil 706. The low-capacity coil 706 is fluidly coupled to a low-capacity refrigerant line 708 and the high-capacity coil 704 is fluidly coupled to a high-capacity refrigerant line 710. The high-capacity refrigerant line 710 is fluidly coupled to the low-capacity refrigerant line 708 via the solenoid valve 702. Thus, by operation of the solenoid valve 702, refrigerant flow to the high-capacity coil 704 can be interrupted during partial-load operation.

An HVAC system equipped with a multi-stage or variable speed compressor and a constant-air-volume blower will become unable to maintain a suitable ratio of sensible capacity to total capacity (S/T) as the refrigerant flow rate decreases. In constant-air-volume systems, a decrease in refrigerant flow rate will cause the S/T ratio to rise. Systems having an S/T ratio above approximately 80% are generally considered unsuitable. The use of the high-capacity coil 704, the low-capacity coil 706, and the solenoid valve 702 enables the evaporator system 700 to preserve the S/T ratio at acceptable levels during part-load operation.

During periods when an HVAC compressor system such as, for example, the condenser system 200 is operating at part load or with reduced refrigerant flow rate, electrical current to the solenoid valve 702 is interrupted thereby causing the solenoid valve 702 to close and prevent refrigerant flow to the high-capacity coil 704. Limiting refrigerant flow to only the low-capacity coil 706 allows a reduced refrigerant mass flow rate to maintain a required coil temperature in the low-capacity coil 706 necessary to maintain a desired S/T ratio.

Figure 8:
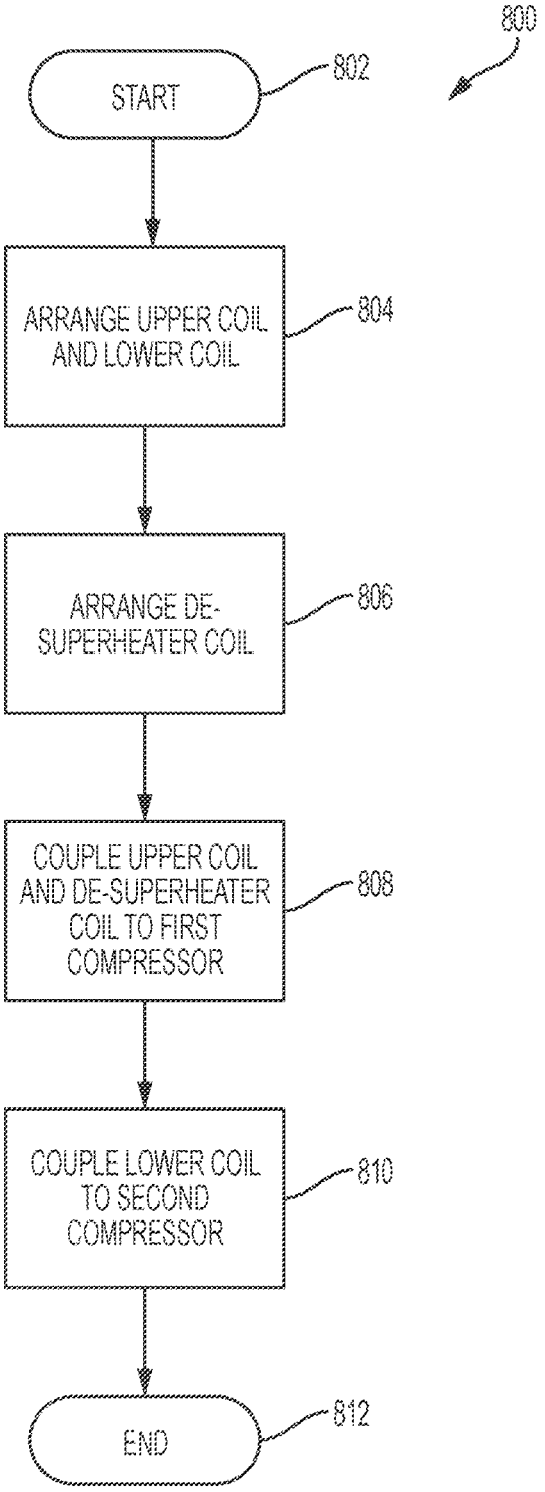
FIG. 8 is a flow diagram illustrating an exemplary process for improving HVAC efficiency.

FIG. 8 is a flow diagram illustrating an exemplary process 800 for improving HVAC efficiency. For purposes of discussion, FIG. 8 will be described herein relative to FIGS. 2-3. The process 800 begins at step 802. At step 804, an upper coil 202 is arranged above a lower coil 206. At step 806, a de-superheater coil 204 is arranged inwardly, that is downstream, of the lower coil 206. In a typical embodiment, the upper coil 202 and the de-superheater coil 204 together utilize an entire surface area available for heat transfer. At step 808, the upper coil 202 and the de-superheater coil 204 are fluidly coupled to the 210 to form the first compressor circuit 203. At step 810, the lower coil 206 is fluidly coupled to the second compressor 208 to form the second compressor circuit 205. In a typical embodiment, the de-superheater coil 204 increases a heat-rejection capacity of the condenser system 200. The process 800 ends at step 812.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others. "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. An evaporator system, comprising:

a high-capacity evaporator coil fluidly coupled to a high-capacity refrigerant line;

a low-capacity evaporator coil fluidly coupled to a low-capacity refrigerant line;

a solenoid valve fluidly coupling the high-capacity refrigerant line to the low-capacity refrigerant line;

wherein the solenoid valve is closed responsive to a reduced mass flow rate of refrigerant;

wherein the solenoid valve, when closed, restricts flow of refrigerant to the high-capacity evaporator coil;

wherein the high-capacity evaporator coil and the low-capacity evaporator coil are not identical in size; and wherein using the high-capacity evaporator coil, the low-capacity evaporator coil, and the solenoid valve enables the evaporator system to maintain a suitable ratio of sensible capacity to total capacity (S/T) when the solenoid valve is closed.

2. The evaporator system of claim 1, wherein the solenoid valve is closed responsive to an HVAC system operating in partial-load operation.

3. The evaporator system of claim 2, wherein the high-capacity evaporator coil and the low-capacity evaporator coil improve efficiency of the HVAC system in partial-load operation.

4. The evaporator system of claim 1, wherein the high-capacity evaporator coil and the low-capacity evaporator coil are fluidly coupled to a compressor circuit.

5. A method comprising:

fluidly coupling a high-capacity evaporator coil to a high-capacity refrigerant line;

fluidly coupling a low-capacity evaporator coil to a low-capacity refrigerant line;

fluidly coupling, using a solenoid valve, the high-capacity refrigerant line to the low-capacity refrigerant line;

restricting flow of refrigerant to the high-capacity evaporator coil by closing the solenoid valve by reducing mass flow rate of refrigerant;

wherein the high-capacity evaporator coil and the low-capacity evaporator coil are not identical in size; and wherein using the high-capacity evaporator coil, the low-capacity evaporator coil, and the solenoid valve enables the evaporator system to maintain a suitable ratio of sensible capacity to total capacity (S/T) when the solenoid valve is closed.

6. The method of claim 5, comprising operating an HVAC system in partial-load operation responsive to closing the solenoid valve.

7. The method of claim 6, wherein the high-capacity evaporator coil and the low-capacity evaporator coil improve efficiency of the HVAC system in partial-load operation.

8. The method of claim 7, comprising maintaining a desired S/T ratio of the HVAC system responsive to restricting refrigerant flow to the high-capacity evaporator coil.

9. The method of claim 5, comprising fluidly coupling the high-capacity evaporator coil and the low-capacity evaporator coil to a compressor circuit.

10. A heating, ventilation, and air conditioning (HVAC) system comprising:

an evaporator system for use in conjunction with a condenser system;

wherein the evaporator system comprises:

a high-capacity evaporator coil fluidly coupled to a high-capacity refrigerant line;

a low-capacity evaporator coil fluidly coupled to a low-capacity refrigerant line;

a solenoid valve fluidly coupling the high-capacity refrigerant line to the low-capacity refrigerant line;

wherein the solenoid valve is closed responsive to a reduced mass flow rate of refrigerant;

wherein the solenoid valve, when closed, restricts flow of refrigerant to the high-capacity evaporator coil;

wherein the high-capacity evaporator coil and the low-capacity evaporator coil are not identical in size; and wherein using the high-capacity evaporator coil, the low-capacity evaporator coil, and the solenoid valve enables the evaporator system to maintain a suitable ratio of sensible capacity to total capacity (S/T) when the solenoid valve is closed.

11. The HVAC system of claim 10, wherein the solenoid valve is closed responsive to an HVAC system operating in partial-load operation.

12. The HVAC system of claim 11, wherein the high-capacity evaporator coil and the low-capacity evaporator coil improve efficiency of the HVAC system in partial-load operation.

13. The HVAC system of claim 10, wherein the high-capacity evaporator coil and the low-capacity evaporator coil are fluidly coupled to a compressor circuit.

14. The HVAC system of claim 10, wherein the condenser system comprises:

a first compressor;

a second compressor;

an upper coil and a de-superheater coil fluidly coupled to the first compressor, the upper coil, the de-superheater coil, and the first compressor defining a first compressor circuit; and a lower coil fluidly coupled to the second compressor, the lower coil and the second compressor defining a second compressor circuit.

15. The HVAC system of claim 10, wherein the de-superheater coil is disposed downstream of the lower coil.

16. The HVAC system of claim 10, wherein the first compressor has a greater capacity than the second compressor.

17. The HVAC system of claim 16, wherein the capacity of the first compressor facilitates heat rejection by the first compressor circuit.

18. The HVAC system of claim 10, wherein:

during full-load operation, the first compressor circuit and the second compressor circuit are active; and during partial-load operation, the first compressor circuit is active and the second compressor circuit is inactive.

* * * * *